US008852037B2

(12) United States Patent
Epling et al.

(10) Patent No.: US 8,852,037 B2
(45) Date of Patent: Oct. 7, 2014

(54) BALL BAT HAVING IMPROVED STRUCTURE TO ALLOW FOR DETECTION OF ROLLING

(75) Inventors: Sean S. Epling, Portland, OR (US); Brian S. Hayes, Benicia, CA (US); Mark A. Fritzke, Portland, OR (US); Bradley L. Gaff, Woodridge, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 145 days.

(21) Appl. No.: 13/535,421

(22) Filed: Jun. 28, 2012

(65) Prior Publication Data

US 2013/0184107 A1 Jul. 18, 2013

Related U.S. Application Data

(60) Provisional application No. 61/586,283, filed on Jan. 13, 2012.

(51) Int. Cl.
*A63B 59/06* (2006.01)

(52) U.S. Cl.
USPC ..... 473/567

(58) Field of Classification Search
CPC .. A63B 59/00; A63B 59/06; A63B 2209/023; A63B 2209/026; A63B 2209/00; A63B 2209/02
USPC ..... 473/457, 519, 520, 564–568
See application file for complete search history.

(56) References Cited

U.S. PATENT DOCUMENTS

| | | | | |
|---|---|---|---|---|
| 3,972,528 A | | 8/1976 | McCracken et al. | 273/72 |
| 4,644,630 A | | 2/1987 | Blum | 29/453 |
| 4,848,745 A | * | 7/1989 | Bohannan et al. | 473/119 |
| 5,301,940 A | * | 4/1994 | Seki et al. | 473/567 |
| 6,056,655 A | | 5/2000 | Feeney | 473/567 |
| 6,251,034 B1 | | 6/2001 | Eggiman | 473/567 |
| 6,287,221 B1 | | 9/2001 | Pino | 473/564 |
| 6,383,101 B2 | | 5/2002 | Eggiman | 473/567 |
| 6,497,631 B1 | | 12/2002 | Fritzke | 473/566 |
| 6,743,127 B2 | | 6/2004 | Eggiman | 473/564 |
| 6,866,598 B2 | | 3/2005 | Giannetti et al. | 473/567 |
| 6,875,137 B2 | | 4/2005 | Forsythe et al. | 473/566 |
| 6,905,429 B2 | | 6/2005 | Forsythe et al. | 473/566 |
| 6,945,886 B2 | | 9/2005 | Eggiman | 473/566 |
| 6,997,826 B2 | | 2/2006 | Sutherland | 473/567 |
| 7,014,580 B2 | | 3/2006 | Forsythe et al. | 473/564 |
| 7,097,578 B2 | | 8/2006 | Guenther | 473/567 |
| 7,115,054 B2 | | 10/2006 | Giannetti | 473/567 |
| 7,163,475 B2 | | 1/2007 | Giannetti | 473/567 |
| 7,229,370 B1 | | 6/2007 | Vacek | 473/567 |

(Continued)

*Primary Examiner* — Mark Graham

(74) *Attorney, Agent, or Firm* — Terence P. O'Brien

(57) ABSTRACT

A ball bat extending about a longitudinal axis. The bat includes a handle and a barrel portion. The barrel portion has a total length and includes a barrel rolling detection region having a length of at least two inches. The detection region is formed of a fiber composite material. The composite material includes at least first and second plies. The first and second plies each include first and second pluralities of fibers aligned adjacent to one another and first and second resins, respectively. The first and second pluralities of fibers of the first and second plies are generally aligned to define first and second angles with respect to the axis, respectively. The first ply is positioned over and within 0.002 in of the second ply. The first and second angles are each within the range of 20 to 80 degrees. The first and second angles are substantially the same.

26 Claims, 8 Drawing Sheets

(56) References Cited

U.S. PATENT DOCUMENTS

| | | | | |
|---|---|---|---|---|
| 7,232,387 | B1 | 6/2007 | Heald | 473/566 |
| 7,361,107 | B2 | 4/2008 | Giannetti | 473/567 |
| 7,384,354 | B2 | 6/2008 | Giannetti | 473/567 |
| 7,699,725 | B2 * | 4/2010 | McNamee et al. | 473/567 |
| 7,857,719 | B2 | 12/2010 | Giannetti et al. | 473/567 |
| 7,914,404 | B2 * | 3/2011 | Giannetti et al. | 473/566 |
| 8,052,547 | B2 | 11/2011 | Nusbaum et al. | 473/457 |
| 8,376,881 | B2 * | 2/2013 | Chuang et al. | 473/567 |
| 2004/0209716 | A1 * | 10/2004 | Vacek et al. | 473/567 |
| 2005/0070384 | A1 * | 3/2005 | Fitzgerald et al. | 473/567 |
| 2006/0025253 | A1 * | 2/2006 | Giannetti et al. | 473/567 |
| 2007/0202974 | A1 * | 8/2007 | Giannetti | 473/564 |
| 2008/0064538 | A1 | 3/2008 | McNamee | 473/564 |
| 2009/0181813 | A1 * | 7/2009 | Giannetti et al. | 473/567 |
| 2009/0197712 | A1 * | 8/2009 | Giannetti et al. | 473/567 |
| 2009/0215559 | A1 * | 8/2009 | McNamee et al. | 473/567 |
| 2009/0215560 | A1 * | 8/2009 | McNamee et al. | 473/567 |
| 2011/0077111 | A1 | 3/2011 | Chauvin et al. | 473/566 |
| 2012/0108368 | A1 | 5/2012 | Epling | 473/564 |
| 2012/0108369 | A1 | 5/2012 | Epling | 473/564 |
| 2012/0108371 | A1 | 5/2012 | Epling | 473/566 |

* cited by examiner

BALL BAT HAVING IMPROVED STRUCTURE TO ALLOW FOR DETECTION OF ROLLING

RELATED APPLICATIONS

The present application claims priority to U.S. Provisional Patent Application Ser. No. 61/586,283 titled BALL BAT HAVING IMPROVED STRUCTURE TO ALLOW FOR DETECTION OF ROLLING, and filed on Jan. 13, 2012. The present application is related to co-pending U.S. patent application Ser. No. 13/535,444, filed on Jun. 28, 2012 herewith by Sean S. Epling, Brian S. Hayes, Mark A. Fritzke and Bradley L. Gaff and entitled BALL BAT HAVING IMPROVED STRUCTURE TO ALLOW FOR DETECTION OF ROLLING, the full disclosure of which are hereby incorporated by reference.

FIELD OF THE INVENTION

The present invention relates to a ball bat having an improved structure to allow for detection of rolling.

BACKGROUND OF THE INVENTION

Baseball and softball organizations periodically publish and update equipment standards and/or requirements including performance limitations for ball bats. Ball bat manufacturers produce ball bats designed to meet the applicable performance limitations of the applicable baseball and softball organizations. Some individuals or groups, commonly referred to as "bat doctors", intentionally manipulate the construction of ball bats previously approved by certain baseball and softball organizations in an effort to change the performance of such ball bats to levels beyond the applicable limitations and/or restrictions. For example, bat doctors have been found to remove end caps of ball bats and shave or otherwise remove material from the inner surfaces of the ball bat. This practice has occurred frequently on aluminum ball bats, and typically results in the wall thickness of the barrel portion of the bat becoming thinner thereby enabling the bat to perform beyond the performance limits. However, such bat shaving or material removal severely limits the useful life of such ball bats.

Many ball bats include barrel portions constructed of a fiber composite material formed by several discrete sheets or layers of fibers aligned in a resin. Some ball bats constructed of fiber composite material can become more responsive when rolled, repeatedly compressed in a vice, or otherwise severely compressed. The rolling or compression of such composite ball bats can cause the resin or other material between the layers of fibers to break or fracture enabling the layers of fiber composite material to move with respect to each other upon impact with a ball and provide enhanced performance. The condition is sometimes referred to as a "double-wall effect". A composite bat that has been "rolled" will often exhibit no visible signs or evidence of having been tampered with. Accordingly, a concern exists in the Industry that players may be using ball bats that have been rolled or otherwise manipulated by bat doctors such that the ball bat that originally satisfied all the performance requirements of applicable baseball or softball organizations, now may exceed those performance limitations giving that player an unfair advantage and potentially raising other issues.

Accordingly, a need exists for a ball bat having a barrel portion formed of a fiber composite material that will fail during rolling or that will provide other indications or evidence of having been rolled or otherwise improperly tampered with. What is needed is a bat that fails when rolled, or begins to fail when rolled such that an umpire, coach or other baseball or softball organization representative can readily determine whether such a bat has been improperly rolled or otherwise tampered with.

Still further, some ball bats formed of fiber composite material can break down overtime and normal use thereby enabling the layers of the fiber composite material to move with respect to each other upon impact (in some instances, this is referred to as a double-wall effect). The result can be that such a ball bat formed of a fiber composite material may initially satisfy all performance limitations of applicable baseball and softball organizations, but overtime and use, the composite structure of the barrel portion of the ball bat can begin to break down and allow for the performance of the ball bat to improve often beyond the allowable performance limits. Again, creating an unfair advantage for the player using such a ball bat.

In response to these issues, many baseball and softball organizations such as Little League baseball, American Softball Association, and the National Collegiate Athletic Association ("NCAA") have instituted advanced break in ("ABI") tests in an effort to detect if the performance of the ball bat improves after rolling to such a degree so as to exceed established performance limits. The ABI test can be used as a measure for how a bat will perform after having been rolled or after having been used over an extended period of time. Bats whose performance improves after rolling are rejected. A ball bat that exhibits cracks after or during performance of the bat rolling procedure is considered to have passed such ABI tests.

Accordingly, a need exists for a ball bat construction wherein the barrel portion of the ball bat does not fail or crack during normal use, but when the barrel portion of the bat is rolled in an ABI test, the barrel portion exhibits visible cracks. In other words, a need exists for a ball bat that properly performs and fully satisfies all applicable bat performance limitations of applicable baseball or softball organizations, but fails or shows evidence of failure of the ball bat upon being rolled or otherwise tampered with. What is needed is a bat construction that provides visible evidence to a person inspecting the barrel portion of a bat, that the particular bat has been rolled or otherwise tampered with in an effort to improve the bat's performance beyond applicable specified limits.

SUMMARY OF THE INVENTION

The present invention provides a ball bat extending about a longitudinal axis. The ball bat includes a barrel portion formed at least in part of a fiber composite material. The fiber composite material includes at least first, second and third plies. The first ply includes a first plurality of fibers aligned adjacent to one another and a first resin. The second ply includes a second plurality of fibers aligned adjacent to one another and a second resin. The third ply includes a third plurality of fibers aligned adjacent to one another and a third resin. The first ply is positioned over, and is within 0.002 in of, the second ply and the second ply is positioned over, and is within 0.002 in of, the third ply. Substantially all of the first, second and third pluralities of fibers of the first, second and third plies are generally aligned to define first, second and third angles with respect to the longitudinal axis of the bat, respectively. The first angle is within the range of 20 to 80 degrees, and the second angle is within the range of 20 to 80 degrees. The first angle is the same, or within plus or minus 5 degrees, of the second angle.

According to a principal aspect of a preferred form of the invention, a ball bat extending along a longitudinal axis. The bat includes a handle portion coupled to a barrel portion. The barrel portion has a total length and includes at least one barrel rolling detection region. The detection region has a length measured along the longitudinal axis of at least two inches. The detection region is formed at least in part of a fiber composite material. The fiber composite material includes at least first and second plies as the two outermost plies of the fiber composite material. The first ply includes a first plurality of fibers aligned adjacent to one another and a first resin. The second ply includes a second plurality of fibers aligned adjacent to one another and a second resin. Substantially all of the first and second pluralities of fibers of the first and second plies are generally aligned to define first and second angles with respect to the longitudinal axis of the bat, respectively. The first ply is positioned over, and is within 0.002 in of, the second ply, The first angle is within the range of 20 to 80 degrees, and the second angle is within the range of 20 to 80 degrees. The first angle is the same, or within plus or minus 5 degrees, of the second angle.

According to another principal aspect of a preferred form of the invention, a ball bat extending along a longitudinal axis. The bat includes a barrel portion formed at least in part of a fiber composite material. The fiber composite material includes at least first and second ply arrangements. The first ply arrangement defines a first ply arrangement thickness and includes at least one ply having a first plurality of fibers and at least a first resin. Each of the at least one ply of the first ply arrangement defines at least one first angle with respect to the longitudinal axis. Each of the at least one first angle is of the same angular polarity with respect to the longitudinal axis. The second ply arrangement defines a second ply arrangement thickness and includes at least one ply having a second plurality of fibers and at least a second resin. Each of the at least one ply of the second ply arrangement defines at least one second angle with respect to the longitudinal axis. Each of the at least one second angles is of the same angular polarity with respect to the longitudinal axis. The polarity of the at least one first angle is opposite of the polarity of the at least one second angle. The ratio of the first ply arrangement thickness to the second ply arrangement thickness is at least 1.5. The first ply arrangement is positioned over and within 0.002 in of the second ply arrangement.

This invention will become more fully understood from the following detailed description, taken in conjunction with the accompanying drawings described herein below, and wherein like reference numerals refer to like parts.

DETAILED DESCRIPTION OF THE INVENTION

Figure 1:
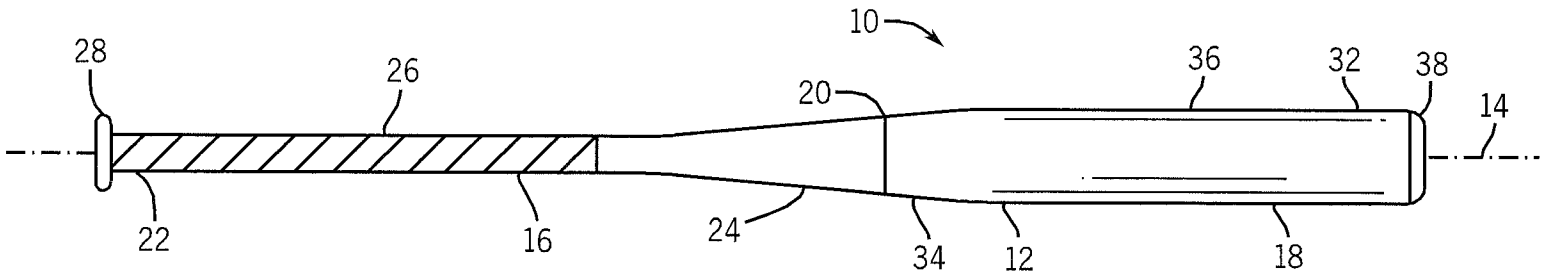
FIG. 1 is a side view of a ball bat in accordance with a preferred embodiment of the present invention.

Referring to FIG. 1, a ball bat is generally indicated at 10. The ball bat 10 of FIG. 1 is configured as a baseball bat; however, the invention can also be formed as a softball bat, a rubber ball bat, or other form of ball bat. The bat 10 includes a frame 12 extending along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

The frame 12 has a relatively small diameter handle portion 16, a relatively larger diameter barrel portion 18 (also referred as a hitting or impact portion), and an intermediate tapered region 20. The intermediate tapered region 20 can be formed by the handle portion 16, the barrel portion 18 or a combination thereof. In one preferred embodiment, the handle and barrel portions 16 and 18 of the frame 12 can be formed as separate structures, which are connected or coupled together. This multi-piece frame construction enables the handle portion 16 to be formed of one material, and the barrel portion 18 to be formed of a second, different material (or two or more different materials).

The handle portion 16 is an elongate structure having a proximal end region 22 and a distal end region 24, which extends along, and diverges outwardly from, the axis 14 to form a substantially frusto-conical shape for connecting or coupling to the barrel portion 18. Preferably, the handle portion 16 is sized for gripping by the user and includes a grip 26, which is wrapped around and extends longitudinally along the handle portion 16, and a knob 28 connected to the proximal end 22 of the handle portion 16. The handle portion 16 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof.

Figure 2:
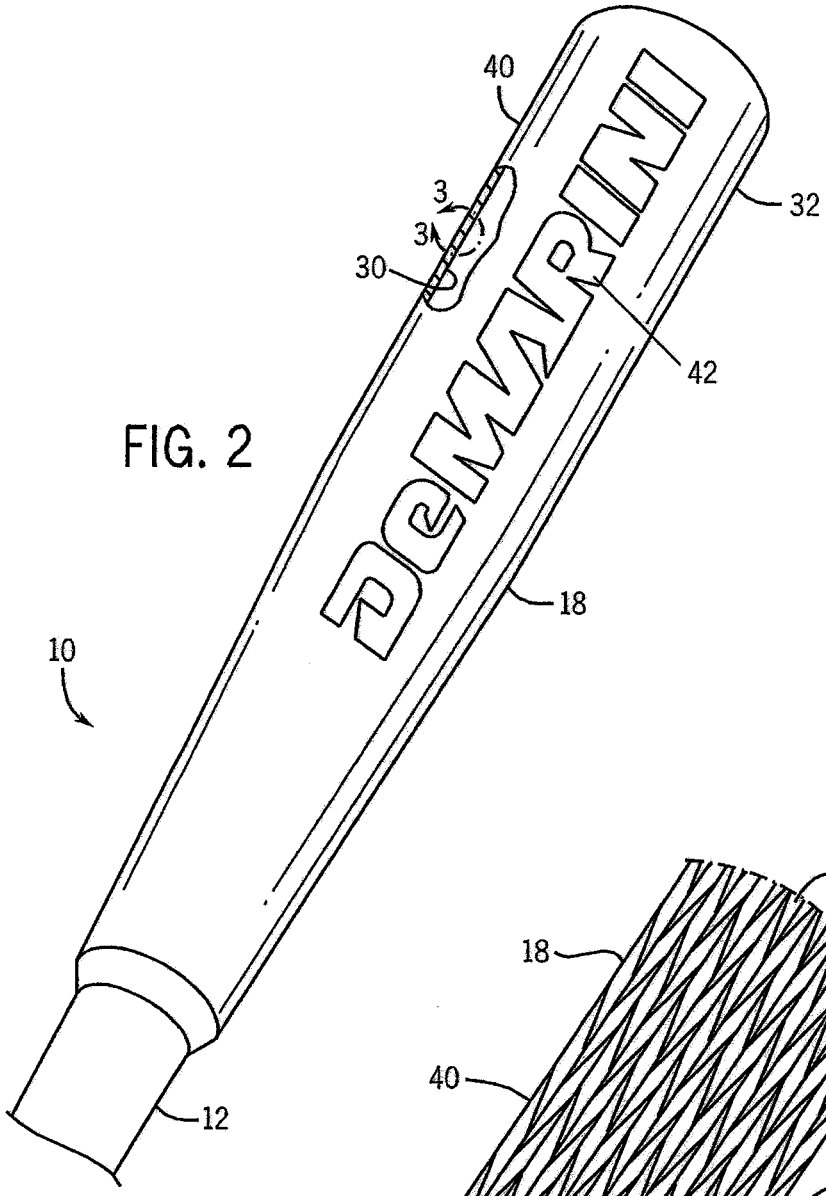
FIG. 2 is a side perspective view of a barrel portion of the ball bat of FIG. 1 including a sectional view of the wall of the barrel portion.

Referring to FIGS. 1 and 2, the barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. The barrel portion 18 extends along the axis 14 and has an inner surface 30, an outer surface 40, a distal end region 32, a proximal end region 34, and a central region 36 disposed between the distal and proximal end regions 32 and 34. The proximal end region 34 converges toward the axis 14 in a direction toward the proximal end of the barrel portion 18 to form a frusto-conical shape that is complementary to the shape of the distal end region 24 of the handle portion 16. The barrel portion 18 can be directly connected to the handle portion 16. The connection can involve a portion, or substantially all, of the distal end region 24 or tapered region 20 of the handle portion 16 and the proximal end region 34 of the barrel portion 18. Alternatively, an intermediate member can be used to space apart and/or attach the handle portion 16 to the barrel portion 18. The intermediate member can space apart all or a portion of the barrel portion 16 from the handle portion 16, and it can be formed of an elastomeric material, an epoxy, an adhesive, a plastic or any conventional spacer material. The bat 10 further includes an end cap 38 attached to the distal end 32 of the barrel portion 18 to substantially enclose the distal end 32.

The barrel portion 18 is preferably formed of strong, durable and resilient material, such as, a fiber composite material. In alternative preferred embodiments, the proximal member 36 can be formed of one or more composite or fiber composite materials, an aluminum alloy, a titanium alloy, a scandium alloy, steel, other alloys, a thermoplastic material, a thermoset material, wood or combinations thereof.

The handle and barrel portions 16 and 18 can be coated and/or painted with one or more layers of paint, clear coat, inks, coatings, primers, and other conventional outer surface coatings. The outer surface 40 of the barrel portion 18 and/or the handle portion 16 can also include alpha numeric and/or graphical indicia 42 indicative of designs, trademarks, graphics, specifications, certifications, instructions, warnings and/or markings. Indicia 42 can be a trademark that is applied as a decal, as a screening or through other conventional means.

Figure 3:
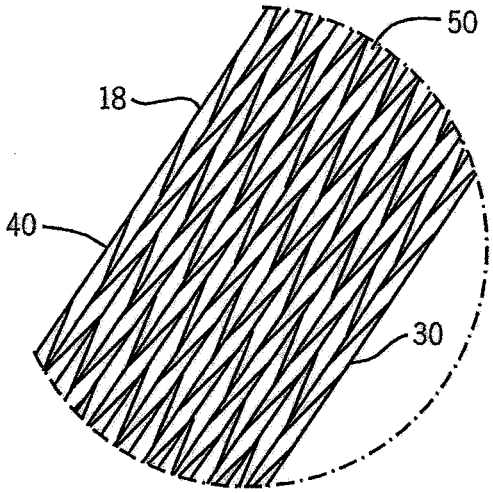
FIG. 3 is an enlarged view of a section of the wall of the barrel portion of the ball bat taken at circle 3 of FIG. 2.
Figure 4:
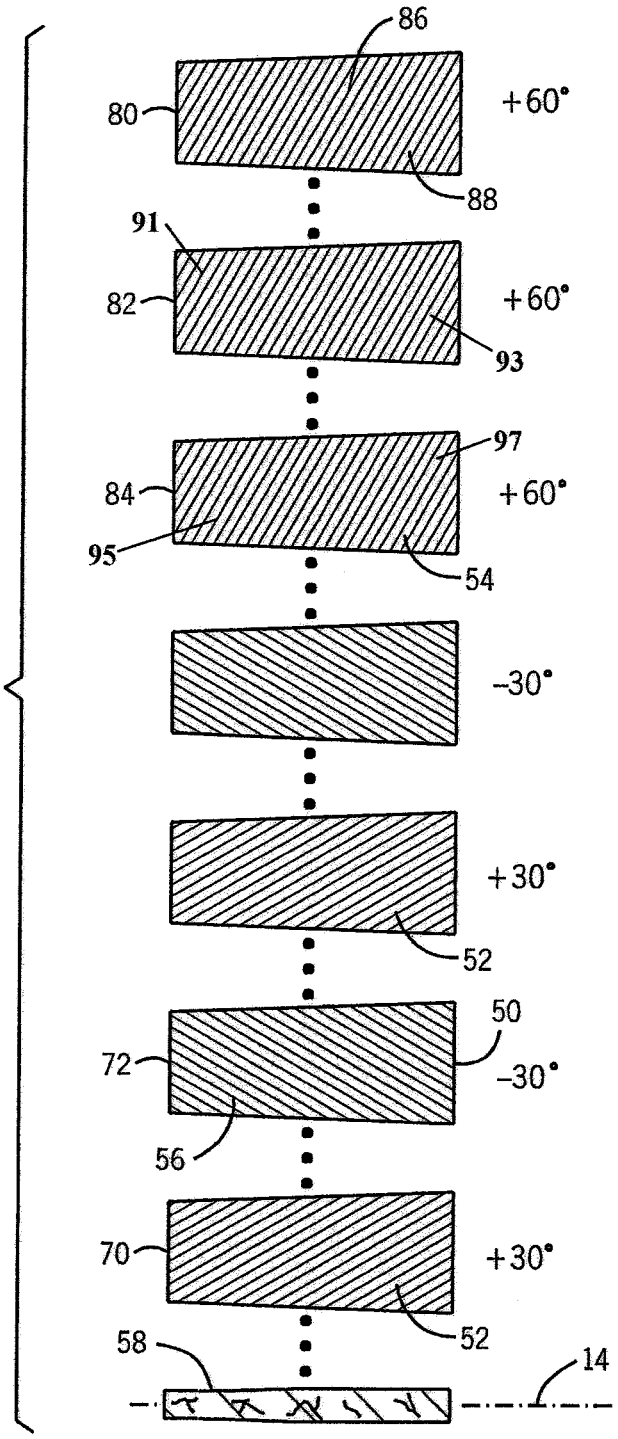
FIG. 4 is side view illustrating a plurality of layers of fiber composite material prior to wrapping around a mandrel in accordance with a preferred embodiment of the present invention.
Figure 5:
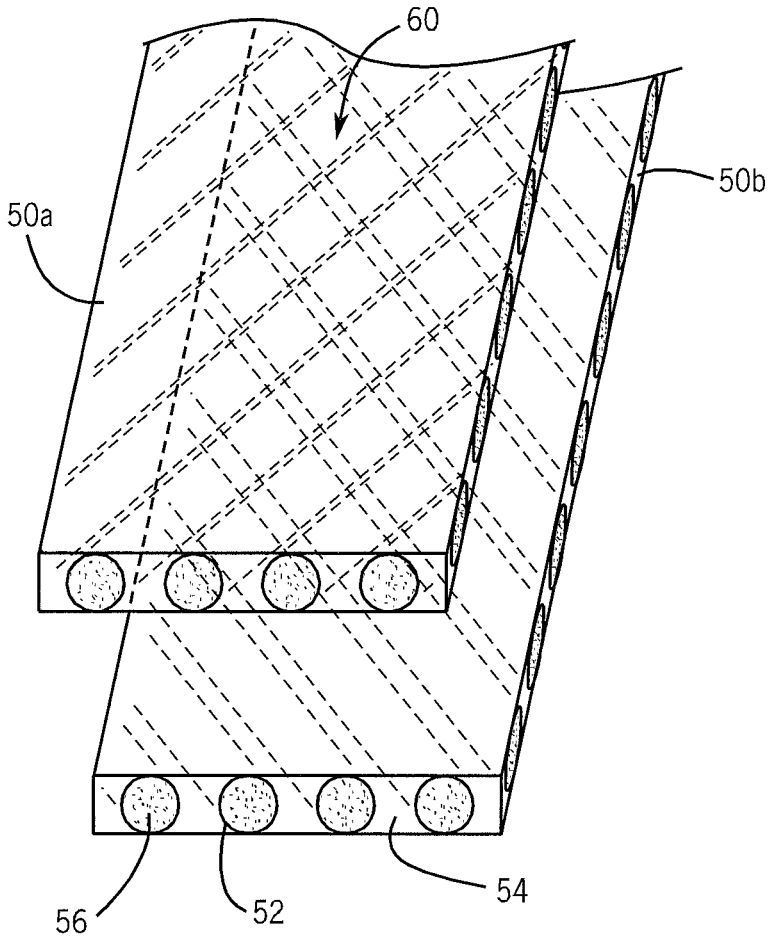
FIG. 5 is a top perspective view of a portion of two representative plies of fiber composite material spaced apart from each other.

Referring to FIGS. 2 through 4, a fiber composite material is preferably used to form at least a portion of the barrel portion 18. As used herein, the terms "composite material" or "fiber composite material" refer to a matrix or a series of plies 50 (also referred to as sheets or layers) of fiber bundles 52 impregnated (or permeated throughout) with a resin 54. Referring to FIGS. 4 and 5, the fiber bundles 52 can be co-axially bundled and aligned in the plies 50.

A single ply 50 typically includes hundreds or thousands of fiber bundles 52 that are initially arranged to extend coaxially and parallel with each other through the resin 54 that is initially uncured. Each of the fiber bundles 52 includes a plurality of fibers 56. The fibers 56 are formed of a high tensile strength material such as carbon. Alternatively, the fibers can be formed of other materials such as, for example, glass, graphite, boron, basalt, carrot, Kevlar®, Spectra®, poly-para-phenylene-2,6-benzobisoxazole (PBO), hemp and combinations thereof. In one set of preferred embodiments, the resin 54 is preferably a thermosetting resin such as epoxy or polyester resins. The resin 54 can be formed of the same material from one ply to another ply. Alternatively, each ply can use a different resin formulation. During heating and curing, the resin 54 can flow between plies 50 and within the fiber bundles 52. The plies 50 preferably typically have a thickness within the range of 0.002 to 0.015 inch. In a particularly preferred embodiment, the ply 50 can have a thickness within the range of 0.005 to 0.006 in. In other alternative preferred embodiments, other thickness ranges can also be used.

The plies 50 are originally formed in flexible sheets or layers. In this configuration, the fibers 56 and the fiber bundles 52 are arranged and aligned such that the fibers 56 generally extend coaxially with respect to each other and are generally parallel to one another. As the ply 50 is wrapped or formed about a mandrel 58 or other forming structure, the ply 50 is shaped to follow the form or follow the shape of the mandrel 58. Accordingly, the fiber bundles 52 and fibers 56 also wrap around or follow the shape of the mandrel 58 or other forming structure. In this formed position or state, the ply 50 is no longer in a flat sheet so the fiber bundles 52 and fibers 56 no longer follow or define generally parallel lines. Rather, the fiber bundles 52 and fibers 56 are adjacent to one another, and are curved or otherwise formed so that they follow substantially the same adjacent paths. For example, if a ply 50 is wrapped about the mandrel 58, the ply 50 can take a generally cylindrical or tubular shape and the fiber bundles 52 and fibers 56 can follow the same cylindrical path or define a helical path (depending upon their angle within the ply 50). The fibers 56 remain adjacent to one another, are aligned with each other and follow substantially similar paths that are essentially parallel (or even co-axial) for example, when viewed in a sectional view in a single plane or other small finite segment of the ply 50.

The fibers 56 or fiber bundles 52 are preferably formed such that they extend along the ply 50 and form generally the same angle with respect to an axis, such as the axis 14. The plies 50 are typically identified, at least in part, by the size and polarity of the angle defined by the fibers 56 or fiber bundles 52 with respect to an axis. Examples of such descriptions of the plies 50 can be fibers 56 or fiber bundles 52 defining a positive 30 degree angle, a negative 30 degree angle, a positive 45 degree angle, a negative 45 degree angle, a positive 60 degree angle, a negative 60 degree angle, a positive 70 degree angle, a negative 70 degree angle, a positive 80 degree angle, a negative 80 degree angle, a 90 degree angle (extending perpendicular to the axis 14), and a 0 degree angle (or extending parallel to the axis 14). Other positive or negative angles can also be used.

Fiber composite material used to form at least a portion of the handle or barrel portions 16 or 18 of the bat 10 typically includes numerous plies 50. The number of plies 50 used to form a barrel portion 18 can be within the range of 3 to 60. In a preferred embodiment, the number of plies 50 used to form the barrel portion 18, or a portion thereof, is at least 10 plies. In an alternative preferred embodiment, the number of plies 50 used to form the barrel portion 18, or a portion thereof, is at least 20 plies.

Referring to FIG. 5, fiber composite materials typically are formed or laid-up using pairs of plies 50 having fiber bundles 52 extending in opposite angular polarities. For example, a ply 50*a* formed of fiber bundles 52 and fibers 56 generally extending at a positive 45 degree angle (also referred to as a plus 45 degree ply) will be paired with a second ply 50*b* that is formed with fiber bundles 52 and fibers 56 generally extending at a negative 45 degree angle (also referred to as a negative 45 degree ply). This pattern typically extends throughout a fiber composite material. The alternating angular arrangement of the fiber bundles 52 and fibers 56 is important to achieving and maintaining the structural integrity of the component or structure being formed of the fiber composite material. The overlapped region, such as region 60, of the two plies 50*a* and 50*b* can be essential for ensuring that, once cured, the fiber composite material has the desired strength, durability, toughness and/or reliability. The transition between alternating pairs of plies 50 can also support the structural integrity of the composite structure. For example, a series of six plies could include a pair of plus and minus 30 degree plies, followed by a pair of plus and minus 45 degree plies, followed by another pair of plus and minus 30 degree plies. The transition from the minus 30 degree ply to the adjacent plus 45 degree ply also provides added structural integrity to the fiber composite material because an overlapped region, such as region 60, still exists from one ply to an adjacent ply.

Figure 9:
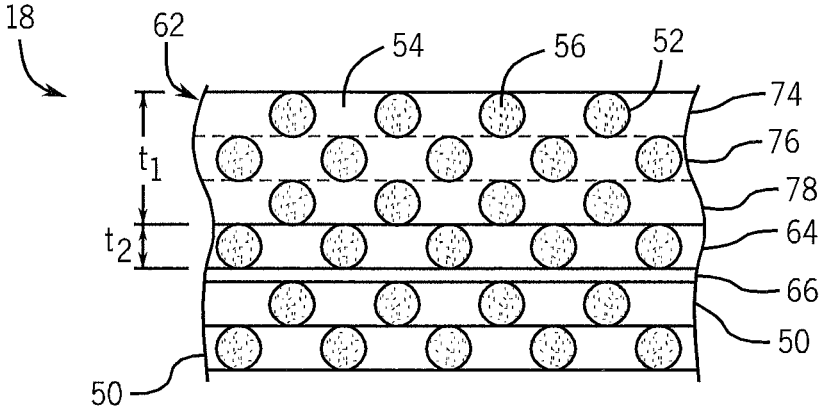
FIG. 9 is an enlarged sectional view of a portion of the fiber composite material of a barrel portion of a ball bat in accordance with a preferred embodiment of the present invention.

Handle and barrel portions 16 and 18 formed of fiber composite material can include several layers of plus and minus angular plies of different values, such as, for example, plus and minus 30 degree plies, plus and minus 45 degree plies, plus and minus 60 degree plies. One or more layers of 0 degree plies, or 90 degree plies can also be used. The plies 50 may be separated at least partially by one or more scrims 66 or veils (FIG. 9).

The composite material is typically wrapped about a mandrel 58 and/or a comparable structure, and cured under heat and/or pressure. While curing, the resin is configured to flow and fully disperse and impregnate the matrix of fiber bundles 52. In alternative embodiments, one or more of the plies, sheet or layers of the composite material can be a braided or weaved sheets or layers. In other alternative preferred embodiments, the one or more plies or the entire fiber composite material can be a mixture of chopped and randomly fibers dispersed in a resin.

Referring to FIG. 4, the mandrel 58 is shown. The mandrel 58 is formed in a shape that defines the inner volume of a tubular barrel portion. The mandrel 58 can be formed of any material that maintains its shape and integrity during the curing process, such as wood. Once the mandrel 58 is in position, the process of "laying up" the plies 50, or layers, comprising the fiber composite material can be performed. The shape and overall size of the plies 50 can vary from one to another. Each ply can be sized to extend about all or a portion of the underlying mandrel 58 or the underlying ply 50. A plurality of uncured plies 50 of fiber composite material can wrapped or otherwise applied about the mandrel 58. In the example of FIG. 4, the inner most ply 70 is a plus 30 degree, followed by a ply 72, which is a minus 30 degree ply that is wrapped about or over the inner most ply 70. A number of other plies can be wrapped or positioned over the plies 70 and 72.

Once the lay-up of the desired number of plies 50 is completed, the mandrel 58 and the wrapped composite layers or plies are heated and cured to form the barrel portion 18. After curing, the mandrel 58 can be removed from the inner surface of the barrel portion 18 through conventional means, such as, for example, extraction or heating.

In accordance with the present invention, and contrary to conventional fiber composite material lay-up configurations, two or more of the outer plies 50 are preferably formed of bundles of fibers 52 and/or fibers 56 generally configured with substantially the same angle. In one preferred embodiment, an outermost or first ply 80 can be a plus 60 degree ply. The outermost ply 80 is positioned directly over and engages a second ply 82, which can also be a plus 60 degree ply. The first and second plies 80 and 82 can then be positioned over a third ply 84 that is also a positive 60 degree ply. Underlying the first, second and third plies 80, 82 and 84 is a plurality of plies 50 having alternating angular orientations, such as minus and plus 30 degree plies 50. FIG. 4 illustrates only some of the plies 50 used to construct the barrel portion. Although the plies 80, 82 and 84 are preferably positioned as the outermost plies of the fiber composite material forming the barrel portion 18, in alternative preferred embodiments the plies 80, 82 and 84 (and other plies of the similar angular polarity) can be positioned beneath the outer ply or outer plies of the fiber composite material.

It has been determined that the arrangement of two or more plies 50 having fiber bundles 52 or fibers 56 extending in substantially the same direction provides unique, unexpected and useful characteristics. Conventional composite lay-up techniques consistently teach and emphasize the alternating of angular positions of multiplies plies to provide proper structural integrity, strength, toughness and durability. Conventional fiber composite material construction does not employ two or more plies having the same angular fiber orientation adjacent to each other because such a lay-up can be very difficult to work with and can result in reduced structural integrity as conventional lay-ups with alternating angles or angles of varying degrees. In addition, the conventional construction of fiber composite materials for barrel portions incorporating the use of plies of alternating angular polarities also allows for a more uniform wall thickness or thickness of the barrel portion 18 to be maintained. However, through extensive testing and experimentation with non-conventional fiber composite constructions, it has been identified that when two or more plies having substantially the same angular orientation are employed in the construction of a barrel portion 18 of a bat 10, the result can provide very desirable results for certain ball bat applications. In particular, it has been determined that a ball bat constructed at least in part of a fiber composite material, wherein two or more adjacent layers or plies having essentially the same angular fiber positions can result in a bat that performs well during normal use satisfying all performance requirements, but fails and exhibits visible cracking when undergoing a bat rolling procedure. The two or more layers or plies are adjacent to each other in that they can be in direct contact with each other, or within 0.002 in of each other. In one preferred embodiment, a thin scrim layer 66 (FIG. 9) can by positioned within or between the two adjacent layers. Such scrim layers are less than 0.002 in thickness.

In a preferred embodiment of the present invention, the barrel portion is formed at least in part of a fiber composite material. The fiber composite material can include the first, second and third plies 80, 82 and 84. The first ply 80 includes a first plurality of fibers 86 aligned adjacent to one another and a first resin 88. The second ply 82 can include a second plurality of fibers 91 aligned adjacent to one another and a second resin 93. The third ply 84 can include a third plurality of fibers 95 aligned adjacent to one another and a second resin 97. The first ply 80 is positioned over the second ply 82, and the second ply is positioned over the third ply 84. Substantially all of the first, second and third plurality of fibers 86, 91 and 95 are generally aligned to define first, second and third angles with respect to an axis, such as the axis 14. The first angle can be within the range of 20 to 80 degrees, and the second angle can be within the range of 20 to 80 degrees. In a particularly preferred embodiment, the first and second angles can be within the range of 50 to 80 degrees. The first angle is preferably the same as the second angle, or is within plus or minus 5 degrees of the second angle. In a particularly preferred embodiment, the first angle can be the same as the second angle, or within plus or minus 3 degrees of the second angle.

In one preferred embodiment, the third angle of the third ply 84 can be of a polarity that is opposite of the polarity of the first and second angles. The first and second angles can be within the range of plus 50 degrees to plus 80 degrees, and the third angle can be within the range of minus 10 degrees to minus 80 degrees. The opposite polarities can also be employed. In one particularly preferred embodiment, referring to Column A of Table 1 below, the first and second plies 80 and 82 can be plus 60 degree plies and the third ply 84 can be a minus 30 ply. Table 1 illustrates some of the preferred embodiments of the present invention.

In another alternative preferred embodiment, the first, second and third angles of the first, second and third plies 80, 82 and 84, respectively, can be the same, or within plus or minus 5 degrees of each other. More preferably, the first, second and third angles of the first, second and third plies 80, 82 and 84, respectively, can be the same, or within plus or minus 3 degrees of each other. The first, second and third angles can be within the range of plus 50 degrees to plus 80 degrees, and a fourth ply 50 can have a fourth angle that is within the range of minus 10 degrees to minus 80 degrees. The opposite polarities can also be employed. In one particularly preferred embodiment, referring to Column B of Table 1 below, the first, second and third plies 80, 82 and 84 can be all plus 60 degrees and the fourth ply 50*d* can be a minus 30 degree ply.

In another alternative preferred embodiment, the first, second, third and fourth angles of the first, second, third and fourth plies 80, 82, 84, 50*d* respectively, can be the same, or within plus or minus 5 degrees of each other. More preferably, the first, second, third and fourth angles of the first, second, third and fourth plies 80, 82, 84, 50*d*, respectively, can be the same, or within plus or minus 3 degrees of each other. The first, second, third and fourth angles can be within the range of plus 50 degrees to plus 80 degrees, and a fifth ply 50*e* can have a fifth angle that is within the range of minus 10 degrees to minus 80 degrees. The opposite polarities can also be employed. In one particularly preferred embodiment, referring to Column C of Table 1 below, the first, second, third and fourth plies 80, 82, 84 and 50*d* can be all plus 60 degrees and the fifth ply 50*e* can be a minus 30 degree ply.

In another alternative preferred embodiment, the first, second, third, fourth and fifth angles of the first, second, third, fourth and fifth plies 80, 82, 84, 50*d* and 50*e*, respectively, can be the same, or within plus or minus 5 degrees of each other. More preferably, the first, second, third, fourth and fifth angles of the first, second, third, fourth and fifth plies 80, 82, 84, 50*d* and 50*e*, respectively, can be the same, or within plus or minus 3 degrees of each other. The first, second, third, fourth and fifth angles can be within the range of plus 50 degrees to plus 80 degrees, and a sixth ply 50*f* can have a sixth angle that is within the range of minus 10 degrees to minus 80 degrees. The opposite polarities can also be employed. In one particularly preferred embodiment, referring to Column D of Table 1 below, the first, second, third, fourth and fifth plies 80, 82, 84, 50*d* and 50*e* can be all plus 60 degrees and the sixth ply 50*f* can be a minus 30 degree ply.

In still other preferred embodiments, the first two, three, four or five outer plies can be formed of the same angle or within plus or minus 5 degrees of each other, and the next inner ply can be formed of an angle that is of the same polarity, but different from the first two, three, four or five outer plies by at least 10 degrees. Columns E and F illustrate examples of outer plies formed in accordance with these alternative preferred embodiments.

The adjacent plies of the substantially the same angle are preferably positioned as the outermost plies of the fiber composite material used to construct the barrel portion 18. For example, the first ply 80 can be the outermost ply, the second ply 82 be the second outermost ply, etc. In alternative preferred embodiments, the group of two, three, four and/or five plies (80, 82, 84, 50*d* and 50*e*) having substantially the same fiber angular orientation can be positioned at other locations within the fiber composite material below the outermost ply or outermost plies.

Table 1 illustrates examples of outermost fiber composite layers or plies in accordance with preferred embodiments of the present invention. Although Table 1 illustrates plies having angles of 60 degrees and 30 degrees, other angular values can also be used and are contemplated in the present invention.

TABLE 1

| Layers or Plies (Outermost Layers to Innermost Layers) | Angle of Fibers with Respect to Longitudinal Axis | | | | | |
|---|---|---|---|---|---|---|
| | A | B | C | D | E | F |
| 1st (Outermost) Item 80 | +60 degrees | +60 degrees | +60 degrees | +60 degrees | +60 degrees | +60 degrees |
| 2nd, Item 82 | +60 degrees | +60 degrees | +60 degrees | +60 degrees | +60 degrees | +60 degrees |
| 3rd, Item 84 | −30 degrees | +60 degrees | +60 degrees | +60 degrees | +30 degrees | +60 degrees |
| 4th, Item 50d | +30 degrees | −30 degrees | +60 degrees | +60 degrees | −30 degrees | −60 degrees |
| 5th, Item 50e | −30 degrees | +30 degrees | −30 degrees | +60 degrees | +30 degrees | +30 degrees |
| 6th, Item 50f | +30 degrees | −30 degrees | +30 degrees | −30 degrees | −30 degrees | −30 degrees |
| 7th, Item 50 | −30 degrees | +30 degrees | −30 degrees | +30 degrees | +30 degrees | +30 degrees |

It has been identified that various factors contribute to the propensity for the barrel portion 18 of the ball bat 10 to exhibit cracking upon barrel rolling, but not during normal use. One factor is placement of the plies 50 having the same angular position at or near the outermost surface of the fiber composite material. Another factor is the number of plies 50 positioned adjacent to each other and having the same angular position. Further, the higher the angle of fibers with respect to the longitudinal axis 14. Placing the plies of the same angular fiber orientation closer to the outer surface of the barrel portion, increasing the number of plies having substantially the same angular fiber orientation, and increasing the angle of the fibers all can contribute to the initiation of visible cracking during barrel rolling of the ball bat. By adjusting these factors and other factors such as the resin material, fiber material, area fiber density, the barrel portion can be optimized to provide optimal performance during organized play, but fail or exhibit visible cracks upon undergoing a barrel rolling procedure.

Figure 6:
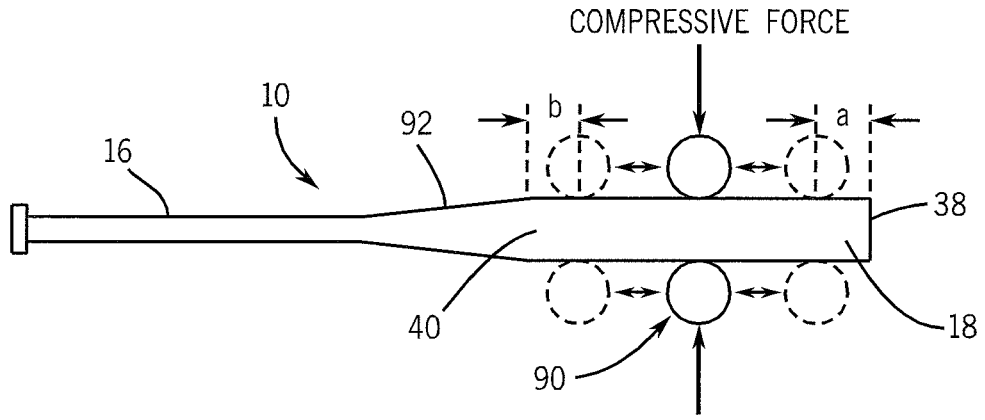
FIG. 6 is side view of a ball bat undergoing a barrel rolling procedure.

Referring to FIG. 6, many baseball and softball organizations such as Little League Baseball, Amateur Softball Association of America ("ASA") and National Collegiate Athletic Association ("NCAA") have developed, have implemented or are implementing accelerated barrel break-in (ABI) procedures or testing protocols. The ABI procedures and protocols are intended to simulate potential performance increasing break-in effects that occur on some bat barrel portions formed of composite materials, or from bat alterations such as shaving or rolling. The ABI procedures include a barrel rolling procedure.

A barrel rolling apparatus is used for performing the barrel rolling procedure. The barrel rolling apparatus can include a pair of wheels or rollers 90. The wheels 90 are formed of a rigid material preferably nylon. Alternatively, the wheels can be formed of aluminum or with an aluminum shell and an inner composite material. The wheels 90 have a diameter within the range of 1.5 to 3.0 inches. In one embodiment, the wheels have a length of 3.75 inches and a diameter of 2.5 inches. The apparatus further includes a fixture for applying a compressive load or force that presses the wheels 90 to the outer surface 40 of the barrel portion 18 of the bat 10. The fixture preferably is configured to press the wheels 90 into the outer surface 40 of the barrel by increments of 0.0125 in or by 0.05 in. The apparatus further includes a device for rolling the barrel, or moving the wheels 90 longitudinally back and forth along the outer surface 40 of the barrel portion 18.

The bat rolling procedure typically involves placing the barrel portion 18 of the bat 10 into the bat rolling fixture with the wheels 90 (or rollers) contacting the outer surface 40 of the barrel portion 18 at a position at is 6 inches from the end cap 38 of the bat 10. The circumferential location of the wheels 90 on the barrel portion 18 can be marked, for example as the 0 degree orientation. The wheels 90 are then displaced closer together by an amount of 0.10 in, 0.0125 in or 0.2 in depending upon the exact procedure being used and whether the rolling is an initial roll or a subsequent roll of the bat 10. The wheels 90 are then rolled with respect to the barrel portion 18 to within a distance, a, of 2.0 to 2.5 inches from the end cap 38, and then back to either within a distance, b, of 2 inches from the taper 92 of the barrel portion 18, or back toward the handle portion 16 until there is no contact between the wheels 90 and the bat 10 (due to the taper of the bat 10). The rolling of the barrel portion 18 with respect to the wheels 90 is repeated 10 times in each direction. Then, the bat 10 is uncompressed by removing the compressive force of the wheels 90 from the barrel portion 18, the bat 10 is rotated 90 degrees from the initial location and the prior rolling steps are repeated. Following the rolling at this position, the bat 10 is rotated a positive 45 degree position and the bat rolling steps are repeated. Then, the bat 10 is rotated to a negative 45 degree position and the rolling steps are repeated.

A ball bat 10 is considered to have passed the ABI and bat rolling procedure if it exhibits significant barrel damage, such as visible cracks are found in the barrel portion (excluding cracks in paint or clear coatings) or visible dents. If a bat's performance exceeds established performance limits during a performance test, or the bat makes it through the ABI test without signs of visible damage, the bat is considered to have failed the ABI test.

Figure 7:
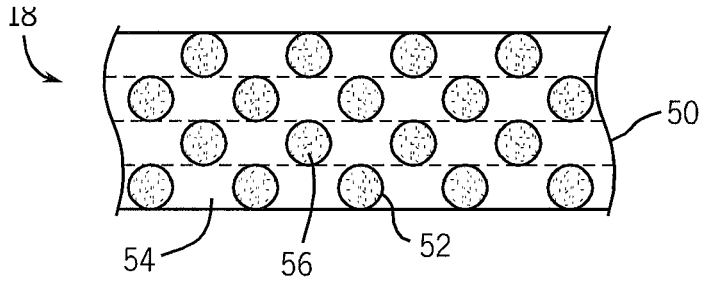
FIG. 7 is an enlarged sectional view of four outer plies of a fiber composite material prior to undergoing a barrel rolling procedure.
Figure 8:
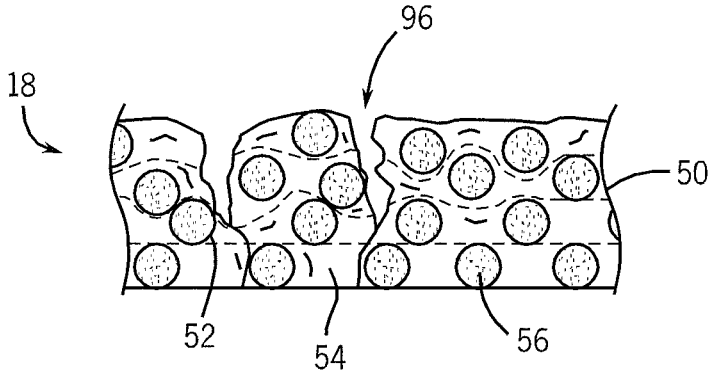
FIG. 8 is the four outer plies of the fiber composite material of FIG. 7 upon performance of the barrel rolling procedure.

Referring to FIGS. 7 and 8, an example of what can happen to a bat constructed in accordance with the present invention upon application of a bat rolling procedure is shown. FIG. 7 is a close up view of four plies 50 of a fiber composite material of the barrel portion 18 prior to undergoing a bat rolling procedure. The fiber bundles 52 of the three outermost plies (top layers) are orientated with substantially the same angle. Prior to rolling the fiber bundles 52 and fibers 56 remain essentially within their respective plies 50. FIG. 8 demonstrates the same sectional close-up sectional view of the four plies of the barrel portion 18 following the rolling procedure. The compressive force or load applied from the bat rolling can induce "nesting" of the fiber bundles from one ply into and between fiber bundles of lower plies. Thus, some of the fiber bundles extend into and between the fiber bundles of the lower plies. This nesting places additional stress on the resin 54 causing cracks 96 to initiate and propagate through the composite material resulting in visible cracks 96 on the outermost surface of the barrel portion 18.

The present invention provides an approach to the construction of the fiber composite material comprising at least part of the barrel portion 18 of the bat 10 that will enable the bat 10 to maintain consistent performance and satisfy required ball bat performance limits of applicable baseball and softball organizations while cracking under the bat rolling procedure such that visible cracks in the barrel portion 18 beyond the paint and other coatings can be found on the barrel portion 18.

The barrel portion 18 can be constructed entirely of a fiber composite material, and the two, three, four or five plies 50 of fiber bundles 52 and fibers 56 extending in substantially the same angular orientation can extend over the entire barrel portion 18. In alternative preferred embodiments, the barrel portion 18 can be constructed such that only a portion of the barrel portion 18 is constructed of fiber composite material. For example, the barrel portion can be a multi-layered structure in which inner or intermediate layers are formed of other materials and the outer layer is formed of a fiber composite material.

Referring to FIG. 9, according to another aspect of the present invention, the construction of at least a portion of a barrel portion of a bat having first and second ply arrangements 62 and 64 is shown. The first and second ply arrangements 62 and 64 refer to a lay-up of one ply 50, or two or more plies 50, wherein each of the plies 50 comprising the first ply arrangement 62 or the second ply arrangement 64 have the same angular polarity with respect to the longitudinal axis 14 of the bat. Accordingly, the first ply arrangement 62 can be formed of a single ply 50, two plies 50, or three or more plies 50 provided that the plurality of fibers 56 of each of the ply 50 or plies 50 making up the first ply arrangement 62 define a single first angle, or two or more first angles that are of the same angular polarity with respect to the longitudinal axis 14. In other words, the ply arrangement 62 can be obtained or procured as a single layer or ply of fiber composite material, but one that has a thickness that is, in this example, three times the thickness of a layer having a single layer of fiber bundles 52. The ply arrangement 62 is considered a single layer, but it has the rows of fiber bundles 52 placed over one another. In other alternative preferred embodiments, the ply arrangement 62 can have single row of fiber bundles, or two rows of fiber bundles, or four or more rows of fiber bundles.

Similarly, the second ply arrangement 64 can be formed of a single ply 50, or two plies 50, or three or more plies 50 provided that the plurality of fibers 56 of each of the ply 50 or plies 50 making up the second ply arrangement 64 define a single second angle or two or more second angles that are of the same angular polarity with respect to the longitudinal axis 14.

Further, the first angle (or first angles) is (are) of an angular polarity that is (are) the opposite polarity of the second angle (or second angles). FIG. 9 illustrates one preferred embodiment in which the first ply arrangement 62 is formed of three separate plies 50 (in particular, plies numbered 74, 76 and 78) and the second ply arrangement 64 is formed of a single ply. Each of the plies 74, 76 and 78 have the same angular polarities with respect to the longitudinal axis 14, and the single ply of the second ply arrangement 64 defines the second angle as being of the opposite polarity of the first angles defined by the first ply arrangement 62. In one particularly preferred embodiment, the ply 74 can define an angle of positive 60 degrees, the ply 76 can define an angle of positive 30 degrees and the ply 78 can define an angle of positive 45 degrees, and the single ply of the second ply arrangement 64 can define an angle of negative 30 degrees. In alternative particularly preferred embodiments, other angular values within the positive range of positive 20 degrees to positive 80 degrees can be used for the plies 74, 76 and 78, and other angular values within the range of negative 20 to negative 80 degrees can be used for the ply 50 (or two or more plies) of the second ply arrangement 64. In another alternative preferred embodiment, the polarities can be reversed such that the first angles defined by the plies 74, 76 and 78 can be negative angles with respect to the horizontal axis (within the range of negative 20 degrees to negative 80 degrees) and the second angle defined by the ply of the second ply arrangement 64 can be a positive angle (within the range of positive 20 degrees to positive 80 degrees). The first ply arrangement 62 is positioned over, or within 0.002 in, of the second ply arrangement 64. In particular, the first ply arrangement 62 can be in direct contact with, or directly engaged to, the second ply arrangement 64; portions of the first ply arrangement 62 can be in contact or engaged to the second ply arrangement 64; or the first ply arrangement 62 can be separated by a thin layer, such as a layer of scrim, by 0.002 in or less from the second ply arrangement 64. Positioned over refers to at least a portion of the first ply or the first ply arrangement being on top of or outer to the second ply or the second ply arrangement.

The plies 50 are formed of a plurality of fibers in a resin. The plies 50 include certain characteristics such as pre-preg area weight ("PPAW"), fiber area weight ("FAW") and resin content. The PPAW is the weight of the fibers and resin per meter squared that represent a ply 50 or represent a ply arrangements, such as the first ply arrangement 62 or the second ply arrangement 64. The PPAW of a ply 50 or of a ply arrangement is preferably within the range of 50 to 500 grams/$m^2$. The FAW is a measure of the weight of the fibers per meter squared within a ply 50 or within a ply arrangement, such as the first or second ply arrangements 62 or 64. The FAW of a ply 50 or of a ply arrangement is preferably within the range of 70 to 240 grams/$m^2$. Resin content is a measure of the amount of resin used per square meter of fiber composite material. The resin content of the resins of the present invention is preferably within the range of 24 to 44 percent.

One characteristic of the present invention is that the first ply arrangement 62 defines a first cured thickness, $t_1$, the second ply arrangement 64 defines a second cured thickness, $t_2$, and the ratio of the first cured thickness, $t_1$, over the second cured thickness $t_2$ is at least 1.5. In another preferred embodiment, the ratio of the first thickness $t_1$ over the second thickness $t_2$ is at least 2.0. The thickness $t_1$ preferably falls within the range of 0.002 to 0.045 in, and the thickness $t_2$ preferably falls within the range of 0.002 to 0.030 in. The first ply arrangement 62, whether it formed of a single ply 50 or two or more plies 50 with each of the plies defining angles with respect to the axis 14 of the same polarity (positive or negative), results in an imbalance of fibers extending in one polarity compared to fibers of the second ply arrangement 64 (which can be a single ply 50 or two or more plies 50). The first thickness $t_1$ of the first ply arrangement 62 is at least 50 percent greater than the second thickness $t_2$ of the second ply arrangement 64, and this imbalance of fibers of greater thickness extending in one angular polarity overlying a thinner ply or ply arrangement having fibers extending in an opposite polarity contributes to the development or propagation of cracks when the barrel portion 18 under goes a rolling procedure. So, although the first ply arrangement 62 may be considered a single layer or purchased as a single layer, because it has a thickness that is at least 1.5 times the thickness of the second ply arrangement 64, it creates an imbalance that can result in the initiation of cracks upon rolling or during an ABI test.

The first and second arrangements 62 and 64 can be the outermost fiber layers of the fiber composite material, or they can be positioned underneath one or more plies 50. A layer of scrim 66 can be positioned between the plies 50 or between the ply arrangements. When used, the scrim 66 or veil will generally separate two adjacent plies and inhibit resin flow between layers during curing. Scrims 66 or veils can also be used to reduce shear stress between layers of the composite material. The scrim 66 or veils can be formed of glass, nylon or thermoplastic materials. In one particular embodiment, the scrim or veil can be used to enable sliding or independent movement between layers of the composite material.

Table 2 illustrates examples of outermost fiber composite layers or plies in accordance with additional preferred embodiments of the present invention. Although Table 2 illustrates examples of ply and ply arrangements having specific angles and thicknesses, other angular values can also be used and are contemplated in the present invention.

TABLE 2

| Plies or Ply Arrangements (Listed from Outermost Layers to Innermost Layers) | | | | | |
|---|---|---|---|---|---|
| Fiber Angle A | Thickness A | Fiber Angle B | Thickness B | Fiber Angle C | Thickness C |
| +60 degrees | Ply Arrangement 62 $t_1$ = 0.015 in | +70 degrees | Ply Arrangement 62 $t_1$ = 0.018 in | +70 degrees | Ply Arrangement 62 $t_1$ = 0.012 in |
| +30 degrees | | +30 degrees | | +45 degrees | |
| +45 degrees | | +45 degrees | | −30 degrees | Ply Arrangement 64 $t_2$ = 0.005 in |
| −30 degrees | Ply Arrangement 64 $t_2$ = 0.006 in | −45 degrees | Ply Arrangement 64 $t_2$ = 0.012 in | +30 degrees | 0.006 in |
| +30 degrees | 0.006 in | −30 degrees | | −45 degrees | 0.006 in |
| −30 degrees | 0.006 in | +30 degrees | 0.006 in | +45 degrees | 0.006 in |
| +30 degrees | 0.006 in | −30 degrees | 0.006 in | −45 degrees | 0.006 in |

In other alternative preferred embodiments, the barrel portion can be formed of two or more separate components that are engaged end to end or overlap each other such that one component extends over only a portion of the entire length of the barrel portion.

Figure 10:
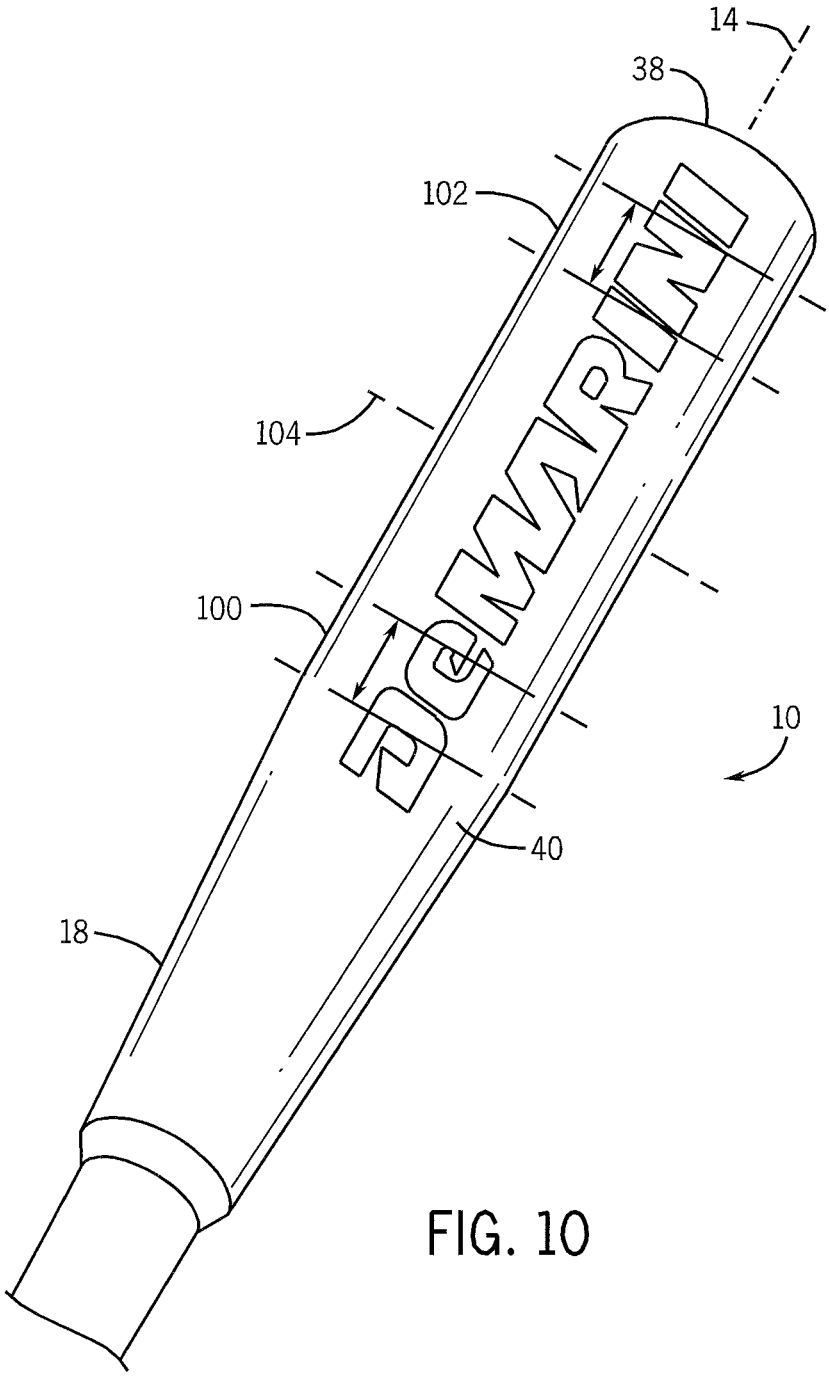
FIG. 10 is side perspective view of a barrel portion of a ball bat in accordance with an alternative preferred embodiment of the present invention.

Referring to FIG. 10, in other alternative preferred embodiments, the barrel portion 18 can be formed at least in part of a fiber composite material and the fiber composite material can include at least one barrel rolling detection region 100. The barrel rolling detection region 100 is a region that includes at least two plies 50 of fiber composite material with substantially the same angular orientation of the fiber bundles 52 and fibers 56 as described above. The detection region 100 can incorporate any of the preferred embodiments of lay-up, orientation and construction of the plies of the fiber composite material discussed above. The detection region 100 can have a length of at least 2 inches and extends over only a portion of the total length of the barrel portion 18. In another alternative preferred embodiment, the barrel portion 18 can include first and second barrel rolling detection regions 100 and 102 that are longitudinally spaced apart from each other. Accordingly, in one preferred embodiment, the barrel portion 18 includes only one detection region 100, and in another alternative preferred embodiment, the barrel portion 18 includes first and second detection regions 100 and 102 that are longitudinally spaced apart from each other. In still other alternative preferred embodiments, three or more detection regions can be used in a barrel portion.

In a particularly preferred embodiment, the barrel rolling detection region 100 is longitudinally spaced apart from the location of the center of percussion ("COP") of the ball bat, location 104. The COP is typically identified in accordance with ASTM Standard F2219-09, *Standard Test Methods for Measuring High-Speed Bat Performance*, published in September 2009. The COP is also known as the center of oscillation or the length of a simple pendulum with the same period as a physical pendulum as in a bat oscillating on a pivot. The COP is often used synonymously with the term "sweet spot." The spacing apart of the detection region 100 from the COP can provide greater flexibility toward barrel construction. In one preferred embodiment, the positioning of the detection region 100 apart from the COP can provide greater assurance that the detection region 100 would not negatively affect the performance of the ball bat at the sweet spot of the bat. In a particularly preferred embodiment, the detection region 100 is proximally longitudinally spaced apart from the COP by at least one inch. In other particularly preferred embodiments, the detection region is proximally longitudinally spaced apart from the COP by at least two inches. In other particularly preferred embodiments, the first detection region 100 can be proximally longitudinally spaced apart from the COP by at least one inch and the second detection region 102 can be distally longitudinally spaced apart from the COP by at least one inch.

Figure 11:
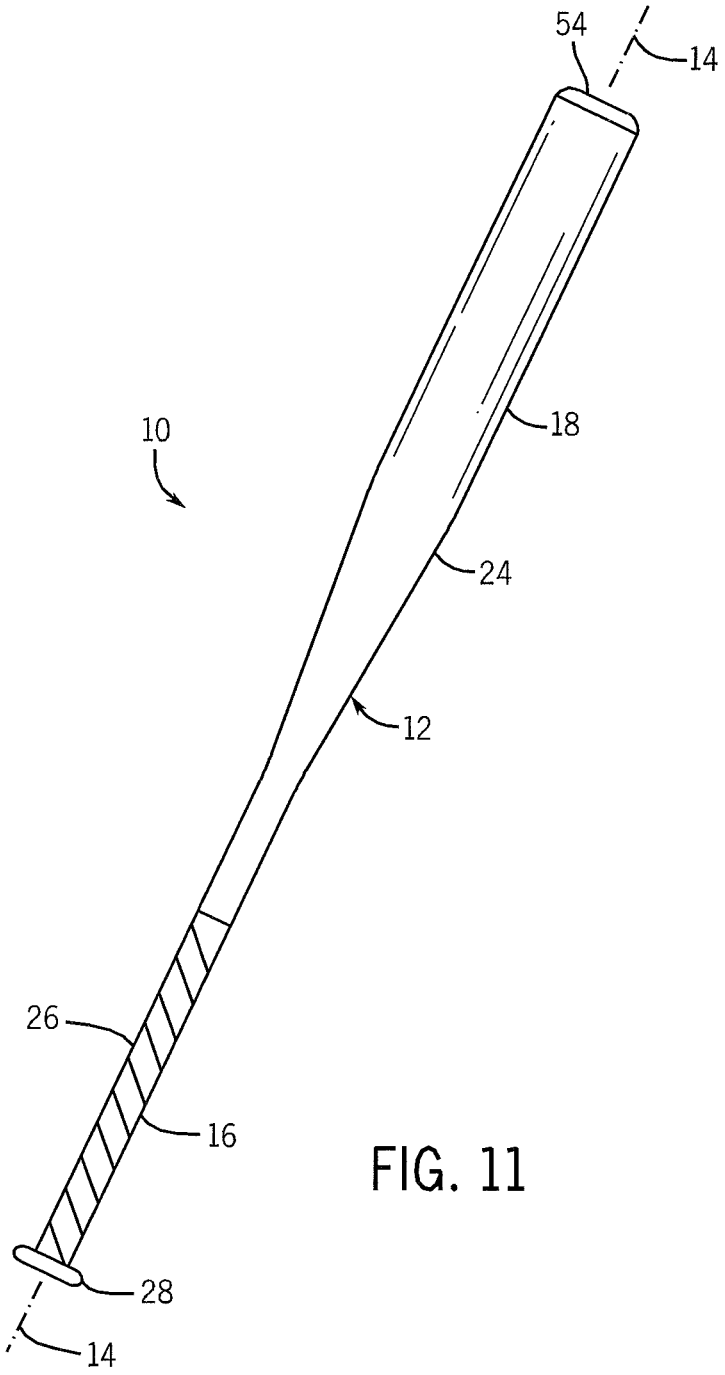
FIG. 11 is side view of a ball bat in accordance with another alternative preferred embodiment of the present invention.

Referring to FIG. 11, in an alternative preferred embodiment, the bat frame 12 of the bat 10 can be formed as a one piece, integral structure. The bat frame 12 includes the handle and barrel portions 16 and 18, but they are formed as single, one-piece body. In other words, the bat frame 12 is not produced as a separate handle and barrel portions that are bonded, molded or otherwise attached together. The use of fiber composite material in the embodiments discussed above for the barrel portion 18 are equally applicable to the one piece bat frame 12.

The bat 10 of the present invention provides numerous advantages over existing ball bats. One such advantage is that the bat 10 of the present invention is configured for competitive, organized baseball or softball. For example, embodiments of ball bats built in accordance with the present invention can fully meet the bat standards and/or requirements of one or more of the following baseball and softball organizations: ASA Bat Testing and Certification Program Requirements; United States Specialty Sports Association ("USSSA") Bat Performance Standards for baseball and softball; International Softball Federation ("ISF") Bat Certification Standards; National Softball Association ("NSA") Bat Standards; Independent Softball Association ("ISA") Bat Requirements; Ball Exit Speed Ratio ("BESR") Certification Requirements of the National Federation of State High School Associations ("NFHS"); Little League Baseball Bat Equipment Evaluation Requirements; PONY Baseball/Softball Bat Requirements; Babe Ruth League Baseball Bat Requirements; American Amateur Baseball Congress ("AABC") Baseball Bat Requirements; and, especially, the NCAA BBCOR Standard or Protocol.

Accordingly, the term "bat configured for organized, competitive play" refers to a bat that fully meets the ball bat standards and/or requirements of, and is fully functional for play in, one or more of the above listed organizations.

Further, bats produced in accordance with the present invention can be configured to fully satisfy existing standards and/or requirements such as ABI and bat rolling procedures while providing players with a bat that is reliable, playable, produces exceptional feel and optimizes performance along the barrel portion or hitting portion of the bat. Bats produced in accordance with the present invention are configured to be durable and reliable and are not prone to failure and shattering during normal use. The present invention significantly improves the flexibility of the bat design further increasing the ability of the bat to be specifically tailored, tuned and designed for a particular player, a particular team, and/or a particular application.

While the preferred embodiments of the invention have been illustrated and described, it will be appreciated that various changes can be made therein without departing from the spirit and scope of the invention. Accordingly, it will be intended to include all such alternatives, modifications and variations set forth within the spirit and scope of the appended claims.

What is claimed is:

1. A ball bat extending along a longitudinal axis, the bat comprising:

a barrel portion formed at least in part of a fiber composite material, the fiber composite material including at least first, second and third plies, the first ply including a first plurality of fibers aligned adjacent to one another and a first resin, the second ply including a second plurality of fibers aligned adjacent to one another and a second resin, the third ply including a third plurality of fibers aligned adjacent to one another and a third resin, the first ply being positioned over and within 0.002 in of the second ply, and the second ply being positioned over and within 0.002 in of the third ply, substantially all of the first, second and third pluralities of fibers of the first, second and third plies being generally aligned to define first, second and third angles with respect to the longitudinal axis, respectively, the first angle being within the range of positive 20 to positive 80 degrees or within the range of negative 20 to negative 80 degrees, and the second angle being within the range of positive 20 to positive 80 degrees or within the range of negative 20 to negative 80 degrees, the first angle being the same or substantially within plus or minus 5 degrees of the second angle.

2. The ball bat of claim 1, wherein the first, second and third plies represent the outermost plies of the fiber composite material of the barrel portion.

3. The ball bat of claim 1, wherein the first and second angles are within plus or minus 3 degrees of each other.

4. The ball bat of claim 1, wherein the first angle is within the range of 50 to 80 degrees, and wherein the second angle is within the range of 50 to 80 degrees.

5. The ball bat of claim 1, wherein the first and second angles are of a first polarity and the third angle is of the opposite polarity.

6. The ball bat of claim 5, wherein the first and second angles are each within the range of positive 50 degrees to positive 80 degrees, and the third angle is within the range of negative 10 degrees to negative 80 degrees.

7. The ball bat of claim 5, wherein the first and second angles are each within the range of negative 50 degrees to negative 80 degrees, and the third angle is within the range of positive 10 degrees to positive 80 degrees.

8. The ball bat of claim 1, wherein the first, second and third angles are within plus or minus 5 degrees of each other.

9. The ball bat of claim 8, wherein the first, second and third angles are within plus or minus 3 degrees of each other.

10. The ball bat of claim 1, wherein at least first, second and third plies includes at least first, second, third and fourth plies, and wherein the first, second and third plies are positioned over and within 0.002 in of the fourth ply, and wherein the fourth ply includes a fourth plurality of fibers aligned adjacent to one another and a fourth resin.

11. The ball bat of claim 10, wherein the first, second and third angles are within plus or minus 5 degrees of each other, and wherein the first, second and third angles are of a first polarity and the fourth angle is of the opposite polarity.

12. The ball bat of claim 10, wherein the first, second, third and fourth angles are within plus or minus 3 degrees of each other.

13. The ball bat of claim 1, wherein the at least first, second and third plies is at least ten plies.

14. The ball bat of claim 1, wherein the at least first, second and third plies is at least twenty plies.

15. The ball bat of claim 1 wherein the first, second and third resins are formed of substantially the same resin material.

16. The ball bat of claim 1, the first, second and third pluralities of fibers are selected from the group consisting of carbon fibers, graphite fibers, glass fibers, boron fibers, basalt fibers, carrot fibers, Kevlar® fibers, Spectra® fibers, poly-para-phenylene-2, 6-benzobisoxazole (PBO) fibers, hemp fibers and combinations thereof.

17. The ball bat of claim 1, further comprising a handle portion, and wherein the barrel portion is coupled to the handle portion.

18. The ball bat of claim 1, further comprising a handle portion integrally formed with the barrel portion to form a one piece bat frame.

19. The ball bat of claim 1, wherein each of the first, second and third plies has a thickness of within the range 0.002 to 0.015 inch.

20. The ball bat of claim 19, wherein each of the first, second and third plies has a thickness of within the range 0.005 to 0.006 inch.

21. The ball bat of claim 1, wherein, when the bat is configured for testing under a barrel rolling procedure, wherein the barrel rolling procedure includes two rigid rollers, a fixture configured to apply a compressive load from the rollers against the barrel portion of the bat, and a mechanism for rolling the rollers along the barrel portion while under the compressive load, and wherein following the rolling of the bat at least 10 times in each of four separate angular roller positions about the barrel portion, visible cracks will be visible in the outer surface of the barrel portion.

22. The ball bat of claim 1, wherein the amount of the first, second and third resins used within the first, second and third plies is within the range of 24 to 44 percent of the total composition of the first, second and third plies, respectively.

23. A ball bat extending along a longitudinal axis, the bat comprising:

a handle portion; and a barrel portion having a total length and coupled to the handle portion, the barrel portion including at least one barrel rolling detection region, the detection region having a length measured with respect to the longitudinal axis of at least two inches, the detection region being formed at least in part of a fiber composite material, the fiber composite material including at least first and second plies of the fiber composite material, the first ply including a first plurality of fibers aligned adjacent to one another and a first resin, the second ply including a second plurality of fibers aligned adjacent to one another and a second resin, substantially all of the first and second pluralities of fibers of the first and second plies being generally aligned to define first, and second angles with respect to the longitudinal axis, respectively, the first ply being positioned over and within 0.002 in of the second ply, the first angle being within the range of 20 to 80 degrees, and the second angle being within the range of 20 to 80 degrees, the first angle being the same or within plus or minus 5 degrees of the second angle.

24. The ball bat of claim 23, wherein the first and second plies are the two outermost plies of the detection region.

25. The ball bat of claim 23, wherein the bat has a center of percussion measured in accordance with ASTM Standard F2219-09, and the at least one detection region is positioned on the barrel portion at a location that is longitudinally spaced apart from the center of percussion.

26. The ball bat of claim 25, wherein the at least one detection region is at least first and second bat rolling detection regions, and wherein each of the first and second detection regions are longitudinally spaced apart from the center of percussion, and wherein the first detection region is positioned proximal to the center of percussion and the second detection region is positioned distal to the center of percussion.

* * * * *